US008147252B1

(12) United States Patent
Stanford et al.

(10) Patent No.: US 8,147,252 B1
(45) Date of Patent: Apr. 3, 2012

(54) CHILD SPOTTER AND ASSOCIATED USE THEREFOR

(76) Inventors: Dolph B. Stanford, Port Orange, FL (US); Bonnie M. Stanford, Port Orange, FL (US)

( * ) Notice: Subject to any disclaimer, the term of this patent is extended or adjusted under 35 U.S.C. 154(b) by 309 days.

(21) Appl. No.: 12/386,898

(22) Filed: Apr. 24, 2009

(51) Int. Cl.
*G09B 19/00* (2006.01)

(52) U.S. Cl. ..... 434/255

(58) Field of Classification Search ..... 434/247, 434/255; 482/43, 69; 119/770, 857
See application file for complete search history.

(56) References Cited

U.S. PATENT DOCUMENTS

| | | | | |
|---|---|---|---|---|
| 1,193,374 | A | 8/1916 | Gilliam | |
| 2,108,566 | A * | 2/1938 | Sanders | 482/69 |
| 4,537,154 | A | 8/1985 | Kay | |
| D300,474 | S | 3/1989 | Caulder et al. | |
| 5,183,007 | A * | 2/1993 | Vincent | 119/770 |
| 5,356,355 | A * | 10/1994 | Campbell | 482/43 |
| 5,388,551 | A * | 2/1995 | Martusciello | 119/770 |
| 5,435,272 | A * | 7/1995 | Epstein | 119/770 |
| 5,476,070 | A * | 12/1995 | Gwon et al. | 119/770 |
| 5,498,219 | A * | 3/1996 | Soufi | 482/69 |
| D383,256 | S | 9/1997 | Hampton | |
| 6,125,792 | A | 10/2000 | Gee | |
| 6,338,699 | B1 * | 1/2002 | Veitch | 482/69 |
| 6,361,478 | B1 * | 3/2002 | Giancaspro | 482/69 |
| 6,968,809 | B2 * | 11/2005 | Reardon | 119/770 |
| 7,017,525 | B2 * | 3/2006 | Leach | 119/770 |
| 7,267,080 | B2 | 9/2007 | Gallo et al. | |
| 7,341,025 | B1 * | 3/2008 | Streeter et al. | 119/857 |
| 7,549,948 | B2 * | 6/2009 | Makofsky | 482/92 |

* cited by examiner

*Primary Examiner* — Kurt Fernstrom
(74) *Attorney, Agent, or Firm* — Montgomery Patent & Design, LLC; Robert C. Montgomery; Joseph T. Yaksich

(57) ABSTRACT

An apparatus and a method of use to assist toddlers who are learning how to walk to be used with their parents/caregivers is herein disclosed. Although resembling a safety climbing harness, the apparatus is specifically designed to safely hold a child who is learning how to walk, climb, ascend steps, and perform other similar physical activities. A plurality of straps surrounds the child comfortably about the shoulder and waist area. These straps join together in a handle assembly located on the rear of the apparatus. This handle assembly is then held by the caregiver as the child walks, climbs stairs, or just generally explore their surroundings. The parent can completely support the child, prevent them from falling, and keep them from wandering off.

18 Claims, 2 Drawing Sheets

CHILD SPOTTER AND ASSOCIATED USE THEREFOR

RELATED APPLICATIONS

The present invention was first described in a notarized Official Record of Invention on Aug. 13, 2008, that is on file at the offices of Montgomery Patent and Design, LLC, the entire disclosures of which are incorporated herein by reference.

FIELD OF THE INVENTION

The present invention relates generally to a harness and, more particularly, to said harness designed to be worn by toddlers which facilitates a wide range of movement and provides a means of control to a caregiver.

BACKGROUND OF THE INVENTION

Young children are delicate little beings that require the utmost care in order protect and keep them safe from harm. As a result, there are a myriad of products intended to provide protection from the everyday dangers encountered as the child grows and explores their new world. Car seats protect them from physical harm while riding in a car and sunshades shield their eyes and skin from the harmful effects of ultraviolet light. High chairs secure them at the dinner table, and barriers keep them from falling down stairs and out of beds.

While there appears to be a product intended to protect infants from a seemingly endless list of dangers, as the infant grows into a toddler the world around them expands infinitely as their ability to move within it. As the toddler begins to walk, climb, and explore the risk of injury from falling and wondering off also increases. These activities are bound to result in minor cuts and scrapes and bruises when first attempted. Later, as the toddler becomes more active and proficient, they take off exploring, thus exposing themselves to even more dangers.

Parents and care providers typically attempt to assist the toddler with these activities and protect them from the inherent dangers of growing up and various attempts have been made in the past to provide a safety and support harness for children. A typical solution is to help by holding their hands; this can not only upsets the child's balance but also puts a strain on the adult as they must slouch or hunch over and puts a strain on the small joints and appendages of the child. Other solutions include the use of a baby walker, safety vest, or similar garments. These solutions can limit the toddler's sense of independence and can impede the natural development of balance the strength. Vests and harnesses can also irritate toddler's sensitive skin and can secure in a manner which can cut off circulation during movement or periods of inactivity. Harnesses which only secure to a child in limited areas can lead to the toddler escaping and elongated support straps and handles can create hazards if not constantly controlled by the caregiver.

Among the relevant attempts to address these problems are several U.S. patents, including U.S. Pat. Nos. 4,537,154; 5,435,272; and 6,968,809.

U.S. Pat. No. 1,193,374, issued in the name of Gilliam, describes a baby-walker comprising a waist belt, shoulder straps, and an extended suspending strap which provides a means for a person to sustain the weight of a child while it learns to walk. The Gilliam device requires the caregiver to retain the suspending strap continuously during activities.

U.S. Pat. No. 6,125,792, issued in the name of Gee, describes a shoulder harness with support handle comprising a pair of shoulder straps, a chest strap, and a handle strap which provides a means to support a child while they learn to skate, ski, or bicycle. The Gee device provides no waist or crotch support.

U.S. Pat. No. 7,267,080, issued in the name of Gallo et al., describes a child support harness comprising a thick belt portion which wraps around the child's midsection and two (2) lift support arms that extend from the side portions of the belt. The support arms are held by the caregiver and provide a means to assist a child with walking and steering the child in a supervised direction.

Additionally, ornamental designs for children's harnesses exist, particularly, U.S. Pat. Nos. D 300,474 and D 383,256. However, none of these designs are similar to the present invention.

While these devices fulfill their respective, particular objectives each suffers from one or more of the described disadvantages. Accordingly, there is a need for a means by which a toddler learning to walk and/or explore can be protected without the disadvantages as described above. The development of the present invention herein described fulfills this need and substantially departs from the conventional solutions and in doing so provides a means by which toddlers can be safely supported without undue strain on the toddler or the caregiver without the aforementioned problems.

SUMMARY OF THE INVENTION

In view of the inherent disadvantages of the foregoing prior art, the inventor recognized and observed that there is a need to provide a means to support and ensure the safety and control of a toddler while considering the physical strain and risk of injury to the care giver and thus, the object of the present invention is to solve the aforementioned problems.

To achieve the above objectives, it is an object of the present invention to provide a means to assist parents or caregivers with the handling of toddlers who are learning how to walk. The invention resembles a safety climbing harness that is specifically designed to safely hold a child who is learning how to walk, climb, ascend steps, and perform other similar physical activities. The invention utilizes a plurality of straps which surround the child comfortably about the shoulder and waist area. The straps are joined together at a handle assembly which is located on the rear side.

Another object of the safety harness is to provide an apparatus comprising two shoulder straps, a sternum strap, a waist strap, two (2) leg apertures, a handle, and a plurality of buckles which provides a means of supporting a toddler and ensuring their safety from potential dangers while providing the additional benefit of reduced physical effort by the care giver. The apparatus comprises a means of size and length adjustment which enables for continued use as the toddler grows.

Yet still another object of the safety harness is to provide the shoulder straps comprising a pair of adjustable textile straps which pass across each shoulder of the toddler and provide a means of support to the apparatus. The shoulder straps intersect at an upper rear portion of the apparatus corresponding to the shoulder area of the toddler. The shoulder strap also comprises an adjustment buckle which provides a means of length adjustment.

Yet still another object of the safety harness is to provide the sternum strap comprising a textile strap which provides a means to wrap around and secure the apparatus to the upper torso of the toddler. The sternum strap also comprises a centrally located sternum buckle which provides a means of releasably fastening the sternum strap around the toddler's chest and of length adjustment.

Yet still another object of the safety harness is to provide the waist strap comprising a textile strap which provides a means to wrap around and secure the apparatus to the lower torso of the toddler. The waist strap comprises a centrally-located waist buckle which provides a means of releasably fastening the waist strap around the toddler's waist and of length adjustment. The waist strap also comprises a plurality of adjustable buckles which provide a means of length adjustment.

Yet still another object of the safety harness is to provide the leg apertures comprising textile straps which loop around the legs of the toddler and provide a safe restraining means to the legs while allowing a wide range of motion. The leg aperture also comprises an adjustable buckle which provides a means of length adjustment.

Yet still another object of the safety harness is to provide the shoulder straps, the sternum strap, the waist strap, and the leg apertures which are durably attached to provide a full body harness to the toddler that is secure and comfortable.

Yet still another object of the safety harness is to provide the handle comprising a padded textile segment located at the intersection of the shoulder straps corresponding to the upper back portion of the toddler parallel to the spine. The handle enables the caregiver to control the toddler's movements and provide assistance as needed while the toddler walks, climbs stairs, or just generally explores their surroundings and provides the caregiver the benefit of not having to repeatedly bend over, thus reducing the physical strain and effort associated with the toddler's activities.

Yet still another object of the safety harness is to provide a method of utilizing the invention which provides a means to enable parents and care providers of toddlers, that are just beginning to walk and explore their world, the ability to completely support and control the child, prevent them from falling, and keep them from wandering off for long periods of time while ensuring the safety and comfort of the child while benefitting from the reduced strain and effort provided by the invention.

Further objects and advantages of the safety harness will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | toddler's spotter |
| 20 | shoulder strap |
| 22 | adjustable buckle |
| 24 | sternum strap |
| 26 | sternum buckle |
| 28 | waist strap |
| 30 | waist buckle |
| 32 | leg aperture |
| 34 | handle |
| 36 | square ring |
| 40 | toddler |
| 50 | caregiver |

DETAILED DESCRIPTION OF THE PREFERRED EMBODIMENT

Figure 1:
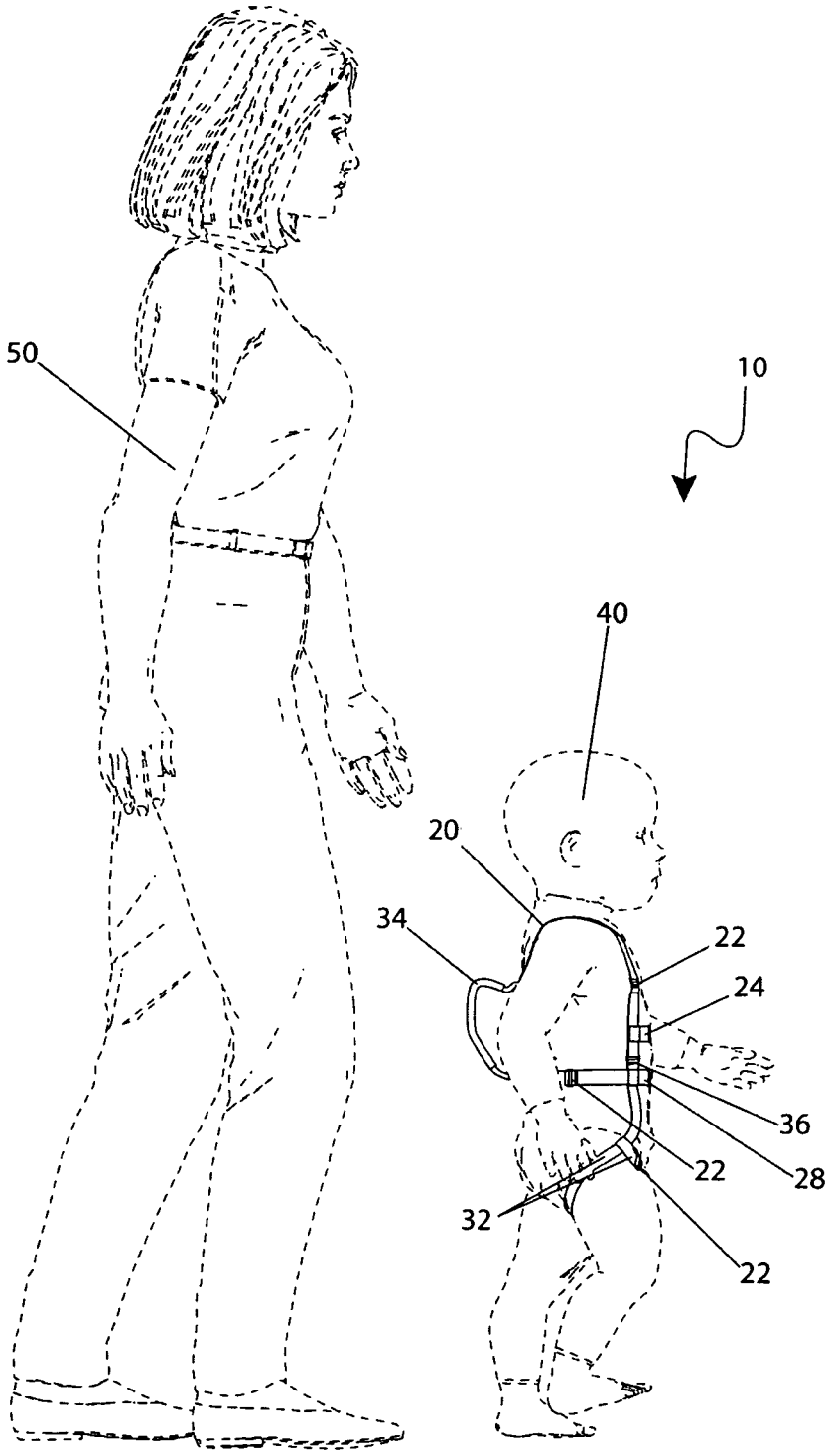
FIG. 1 is an environmental view of a toddler's spotter 10, according to a preferred embodiment of the present invention; and, FIG. 2 is a front perspective view of the toddler's spotter 10, according to a preferred embodiment of the present invention.
Figure 2:
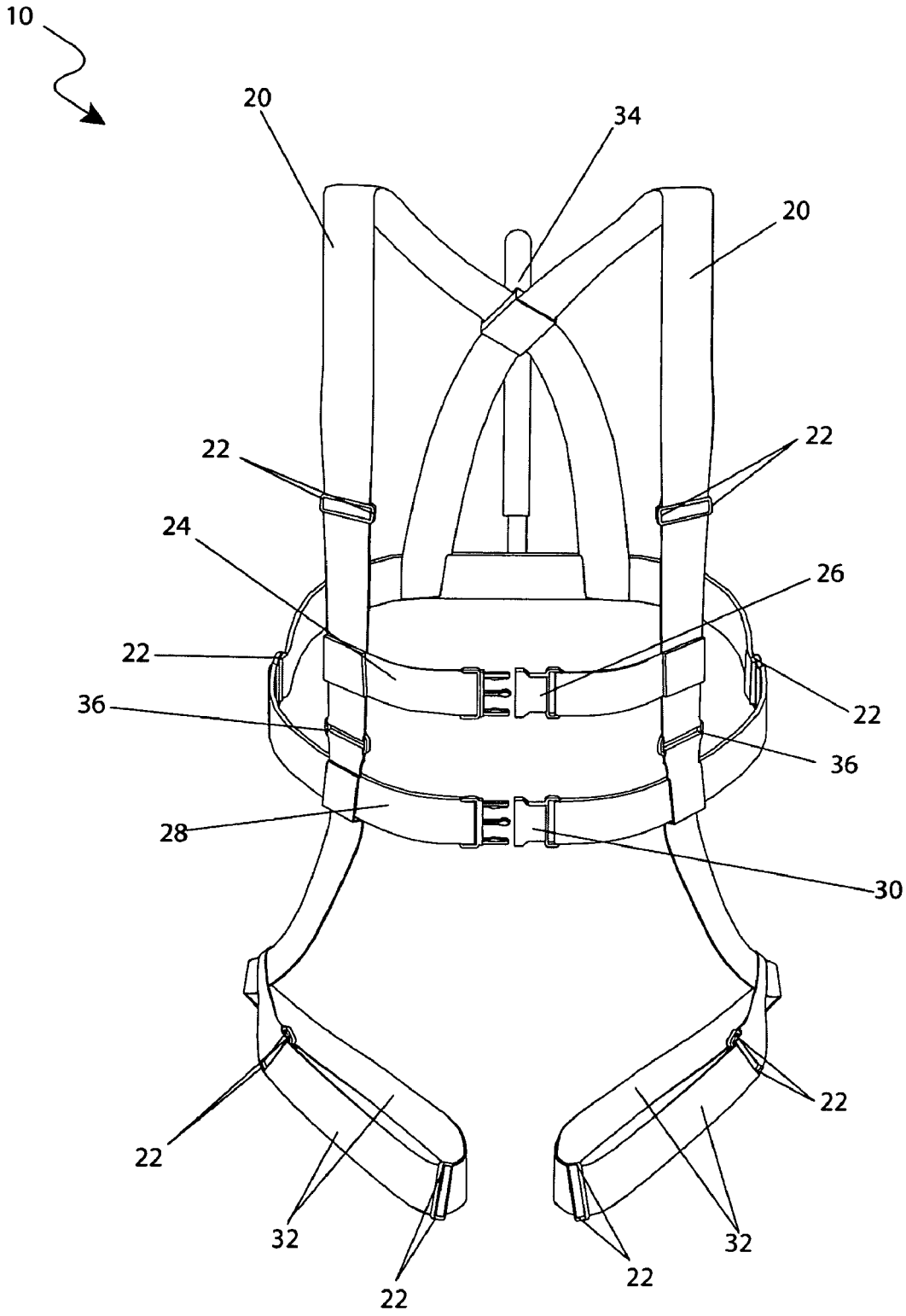

The best mode for carrying out the invention is presented in terms of its preferred embodiment, herein depicted within the FIGS. 1 and 2. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a toddler's spotter (herein described as the "apparatus") 10, which provides a means for a caregiver 50 to support a toddler 40 and ensure their safety and comfort in learning how to walk, climb, ascend steps, and perform other physical activities that could be potentially dangerous should the toddler 40 tumble. The apparatus 10 comprises a shoulder strap 20, a sternum strap 24, a waist strap 28, a pair of buckles 26, 30, a pair of leg apertures 32, and a handle 34. The apparatus 10 is adjustable in size and length allowing for a continued use as the toddler 40 matures. The apparatus 10 is envisioned to be fabricated from rugged and durable strapping materials such as, but not limited to: nylon, cotton, polyester, or the like and created in a variety of colors and/or patterns with color matching fastening components. The proper use of the apparatus 10 provides an effective means thereto support the toddler 40, prevent them from falling, keep them from wandering off, and the like without having the caregiver 50 bend over, straining their back, or risk hurting the toddler 40.

Referring now to FIG. 1, an environmental view of the apparatus 10, according to the preferred embodiment of the present invention, is disclosed. Illustrated here is the proportional position of the toddler 40 thereto the caregiver 50 while the apparatus 10 is in-use. The apparatus 10 possesses similarity thereto conventional safety climbing harnesses; however it can be seen that the apparatus 10 comprises a handle 34 enabling the caregiver 50 to provide control and assistance thereto the toddler 40 without having the caregiver 50 bend over, thereby limiting back stress and strain. The handle 34 is located thereon a back portion of the apparatus 10 parallel thereto the toddler's 40 spine. The handle 34 is padded therewith materials such as, but not limited to: rubber, foam, or the like thereby providing the caregiver 50 with additional comfort.

Referring now to FIG. 2, a front perspective view of the apparatus 10, according to the preferred embodiment of the present invention, is disclosed. The apparatus 10 comprises a sternum strap 24, thereby providing a means to wrap around and secure the apparatus 10 to the toddler 40 at the chest level. The sternum strap 24 provides the aforementioned strapping material in a horizontal orientation, and sewn into the front portion using sewing technologies common in the industry. The sternum strap 24 further comprises an intermediary centrally-located sternum buckle 26 at a front portion of the apparatus 10 which provides an attachment means as well as a length control means for the sternum strap 24. The sternum buckle 26 is illustrated in the preferred embodiment being an adjustable plastic side release type, but can be provided in a variety of adjustable quick release or center release styles common in industry. The sternum strap 24 is attached thereto the waist strap 28 by means of a pair of square rings 36 and sewing technologies common in the industry.

The apparatus 10 also comprises a waist strap 28, thereby providing a means to wrap around and secure the apparatus 10 thereto the toddler 40 at the waist level. The waist strap 28 provides the aforementioned strapping material in a horizontal orientation, and sewn into the front portion using the aforementioned sewing technologies. The waist strap 28 comprises an intermediary centrally-located waist buckle 30 at the front portion of the apparatus 10 which provides an attachment means as well as a length control means for the waist strap 28. The waist buckle 30 comprises the same components and materials as the aforementioned sternum buckle 26. The waist strap 28 also comprises adjustable buckles 22 thereon the side portions allowing for an additional adjustment means to the aforementioned strapping material.

The apparatus 10 further comprises an adjustable pair of shoulder straps 20, thereby providing a means to hold up the apparatus 10. The shoulder straps 20 pass across each shoulder and are sewn and oriented perpendicular to the chest strap 24 and waist strap 28. The shoulder straps 20 intersect each other at a rear upper portion allowing an attachment means thereto the handle 34. Both shoulder straps 20 also comprise adjustable buckles 22, thereby providing additional adjustment means to the aforementioned strapping material.

The apparatus 10 yet further comprises leg apertures 32, thereby providing a placement means for the toddler's 40 legs allowing a wide range of movement while still maintaining safety. Both leg apertures 32 further comprise a pair of adjustable buckles 22, thereby providing additional adjustment means to the aforementioned strapping material. The leg apertures 32 should be adjusted to fit comfortably around the toddler's 40 thigh/crotch region. The leg apertures 32 attach thereto the waist strap 28 by means of a vertically oriented strapping material and the use of sewing technologies common in the industry.

The aforementioned buckles 26, 30, as well as the adjustable buckles 22 are envisioned to be readily available strapping accessories common to the industry such as tri-glides and are made of a durable plastic material typically produced in an injection molded process.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: acquiring the apparatus 10; sitting the toddler 40 thereon the caregivers 50 lap so that the toddler 40 is facing in the same direction as the caregiver 50; placing the toddlers 40 feet through the leg apertures 32; placing the toddlers 40 arms through the shoulder straps 20 and resting the shoulder straps 20 thereon the toddlers 40 shoulders; buckling the sternum buckle 26 and waist buckle 30; adjusting the adjustable buckles 22 thereto fit snuggly on the toddler 40; assisting the toddler 40 by means of the handle 34 as needed; enjoying the increased safety while training the toddler 40; loosening the adjustable buckles 22; unbuckling the sternum buckle 26 and waist buckle 30; assisting the toddler thereto remove his/her legs therefrom the leg apertures 32; removing the apparatus 10; and, reusing as necessary.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A toddler training apparatus for assisting a caregiver to teach walking techniques to a toddler, said toddler training apparatus comprising:

a plurality of shoulder straps;

a sternum strap having opposed ends coupled to said shoulder straps respectively and being positioned along an anterior region of said toddler training apparatus;

a waist strap situated subjacent to said sternum strap and being coupled to said shoulders straps respectively;

a plurality of leg apertures formed at a lower end of said shoulder straps respectively such that said leg apertures are disposed subjacent to said waist strap;

a plurality of buckles conjoined to said sternum and waist straps as well as each of said leg apertures respectively; and, a handle connected to said waist strap and a back portion of said toddler training apparatus, said handle extending rearwardly from said posterior region and being oriented substantially parallel to a central longitudinal axis of said toddler training apparatus;

wherein said shoulder straps define an intersecting zone at said posterior region of said toddler training apparatus;

wherein a top most end of said handle is conjoined directly to said intersecting zone while a bottom most end of said handle is conjoined directly to a single point at said waist strap, said single point being centrally disposed between connections points of said shoulder straps to said waist strap;

wherein each of said shoulder straps has a bottom most end adjustably attached directly to a corresponding one of said leg apertures as well as a corresponding one of said lower end of said shoulder straps respectively.

2. The toddler training apparatus of claim 1, wherein said sternum strap is horizontally oriented along said anterior region, said sternum strap having opposed ends terminating at said shoulder straps and thereby being intermediately located between said shoulder straps, said sternum straps further being disposed substantially midway between said leg apertures and a top region of said shoulder straps respectively.

3. The toddler training apparatus of claim 2, wherein a first one (1) of said buckles is attached to corresponding medial ends of said sternum strap respectively.

4. The toddler training apparatus of claim 3, wherein a second one (1) of said buckles is attached to corresponding medial ends of said sternum strap respectively such that said first and second buckles are vertically aligned and centrally positioned midway between said shoulder straps respectively.

5. The toddler training apparatus of claim 1, wherein said waist strap is horizontally oriented and spans along an outer perimeter of said toddler training apparatus.

6. The toddler training apparatus of claim 1, wherein said shoulder straps are adapted to pass across each other at said posterior region, said shoulder straps having anterior portions vertically extending along said anterior region of said toddler training apparatus, said anterior portions being oriented perpendicular to said chest and waist straps respectively.

7. The toddler training apparatus of claim 1, wherein third and fourth ones of said buckles are coupled to said leg apertures respectively so that each of said leg apertures are independently adjustable between alternate positions.

8. A toddler training apparatus for assisting a caregiver to teach walking techniques to a toddler, said toddler training apparatus comprising:

a plurality of adjustable shoulder straps adapted to be positioned along anterior and posterior sides of the toddler;

a sternum strap having opposed ends coupled to said shoulder straps respectively and being positioned along an anterior region of said toddler training apparatus;

a waist strap situated subjacent to said sternum strap and being coupled to said shoulders straps respectively, said waist strap extending along the anterior region of said toddler training apparatus as well as a posterior region thereof;

a plurality of leg apertures formed at a lower end of said shoulder straps respectively such that said leg apertures are disposed subjacent to said waist strap;

a plurality of buckles independently conjoined to said sternum and waist straps as well as each of said leg apertures respectively; and, a handle connected to said waist strap and a back portion of said toddler training apparatus, said handle extending rearwardly from said posterior region and being oriented substantially parallel to a central longitudinal axis of said toddler training apparatus;

wherein a top most end of said handle is conjoined directly to said intersecting zone while a bottom most end of said handle is conjoined directly to a single point at said waist strap, said single point being centrally disposed between connections points of said shoulder straps to said waist strap;

wherein each of said shoulder straps has a bottom most end adjustably attached directly to a corresponding one of said leg apertures as well as a corresponding one of said lower end of said shoulder straps respectively.

9. The toddler training apparatus of claim 8, wherein said sternum strap is horizontally oriented along said anterior region, said sternum strap having opposed ends terminating at said shoulder straps and thereby being intermediately located between said shoulder straps, said sternum straps further being disposed substantially midway between said leg apertures and a top region of said shoulder straps respectively.

10. The toddler training apparatus of claim 9, wherein a first one (1) of said buckles is attached to corresponding medial ends of said sternum strap respectively.

11. The toddler training apparatus of claim 10, wherein a second one (1) of said buckles is attached to corresponding medial ends of said sternum strap respectively such that said first and second buckles are vertically aligned and centrally positioned midway between said shoulder straps respectively.

12. The toddler training apparatus of claim 8, wherein said waist strap is horizontally oriented and spans along an outer perimeter of said toddler training apparatus.

13. The toddler training apparatus of claim 8, wherein said shoulder straps are adapted to pass across each other at said posterior region, said shoulder straps having anterior portions vertically extending along said anterior region of said toddler training apparatus, said anterior portions being oriented perpendicular to said chest and waist straps respectively.

14. The toddler training apparatus of claim 8, wherein said shoulder straps define an intersecting zone at said posterior region of said toddler training apparatus.

15. The toddler training apparatus of claim 14, wherein a top end of said handle is conjoined to said intersecting zone while a bottom end of said handle is conjoined to said waist strap.

16. The toddler training apparatus of claim 8, wherein third and fourth ones of said buckles are coupled to said leg apertures respectively so that each of said leg apertures are independently adjustable between alternate positions.

17. A method of utilizing said toddler training apparatus for teaching a toddler to walk, said method comprising the steps of:

acquiring said toddler training apparatus comprising:

a plurality of adjustable shoulder straps adapted to be positioned along anterior and posterior sides of the toddler;

a sternum strap having opposed ends coupled to said shoulder straps respectively and being positioned along an anterior region of said toddler training apparatus;

a waist strap situated subjacent to said sternum strap and being coupled to said shoulders straps respectively, said waist strap extending along the anterior region of said toddler training apparatus as well as a posterior region thereof;

a plurality of leg apertures formed at a lower end of said shoulder straps respectively such that said leg apertures are disposed subjacent to said waist strap;

a plurality of buckles independently conjoined to said sternum and waist straps as well as each of said leg apertures respectively, and, a handle connected to said waist strap and a back portion of said toddler training apparatus, said handle extending rearwardly from said posterior region and being oriented substantially parallel to a central longitudinal axis of said toddler training apparatus;

sitting the toddler on a caregiver lap so that the toddler is facing in a same direction as the caregiver;

placing both feet of the toddler through said leg apertures respectively;

placing both arms of the toddler through said shoulder straps;

resting said shoulder straps on corresponding shoulders of the toddler; and, buckling and adjusting each of first and second ones of said buckles so that said sternum and waist straps are maintained at a snug position;

wherein a top most end of said handle is conjoined directly to said intersecting zone while a bottom most end of said handle is conjoined directly to a single point at said waist strap, said single point being centrally disposed between connections points of said shoulder straps to said waist strap;

wherein each of said shoulder straps has a bottom most end adjustably attached directly to a corresponding one of said leg apertures as well as a corresponding one of said lower end of said shoulder straps respectively.

18. The method of claim 17, further comprising the step of: assisting the toddler to walk by grasping said handle and balancing a center of mass of the toddler during walking procedures.

* * * * *